United States Patent [19]

Fujimura et al.

[11] Patent Number: 5,003,856

[45] Date of Patent: Apr. 2, 1991

[54] PAPER CUTTER

[75] Inventors: Yasuo Fujimura, Sendai; Toshio Fujiwara, Kashiwa, both of Japan

[73] Assignee: Sumitsu & Company, Limited, Japan

[21] Appl. No.: 415,611

[22] Filed: Oct. 2, 1989

[30] Foreign Application Priority Data

Jul. 7, 1989 [JP] Japan ..... 1-175946

[51] Int. Cl.[5] ..... B26D 5/08

[52] U.S. Cl. ..... 83/576; 83/578; 83/614; 83/636

[58] Field of Search ..... 83/575, 576, 577, 578, 83/614, 485, 487, 455, 857, 174, 629, 471.2, 636

[56] References Cited

U.S. PATENT DOCUMENTS

| | | | |
|---|---|---|---|
| 2,057,264 | 11/1935 | Pierce | 83/614 |
| 3,486,400 | 12/1969 | Westmijze et al. | 83/576 |
| 3,779,121 | 12/1973 | Lagain | 83/614 |
| 3,788,175 | 1/1974 | Davis | 83/614 |
| 3,797,339 | 3/1974 | Pape et al. | 83/575 |
| 3,954,037 | 5/1976 | Rios | 83/577 |
| 4,383,458 | 5/1983 | Kitai et al. | 83/455 |

*Primary Examiner*—Hien H. Phan
*Assistant Examiner*—Kenneth E. Peterson
*Attorney, Agent, or Firm*—Wall and Roehrig

[57] ABSTRACT

A paper cutter for achieving high speed cutting having a simplified structure since movement of a blade can be controlled by a linear motor. A low level of noise can also be realized since typical mechanical elements for transferring power are eliminated. The movable blade forms less than a fifty degree angle with respect to a blade edge of the stationary blade, in the direction of blade motion, so that locally concentrated wear it minimized. By using a rotary blade as a movable blade, paper can be cut in both directions by reciprocating the movable blade.

3 Claims, 3 Drawing Sheets

Fig. 2
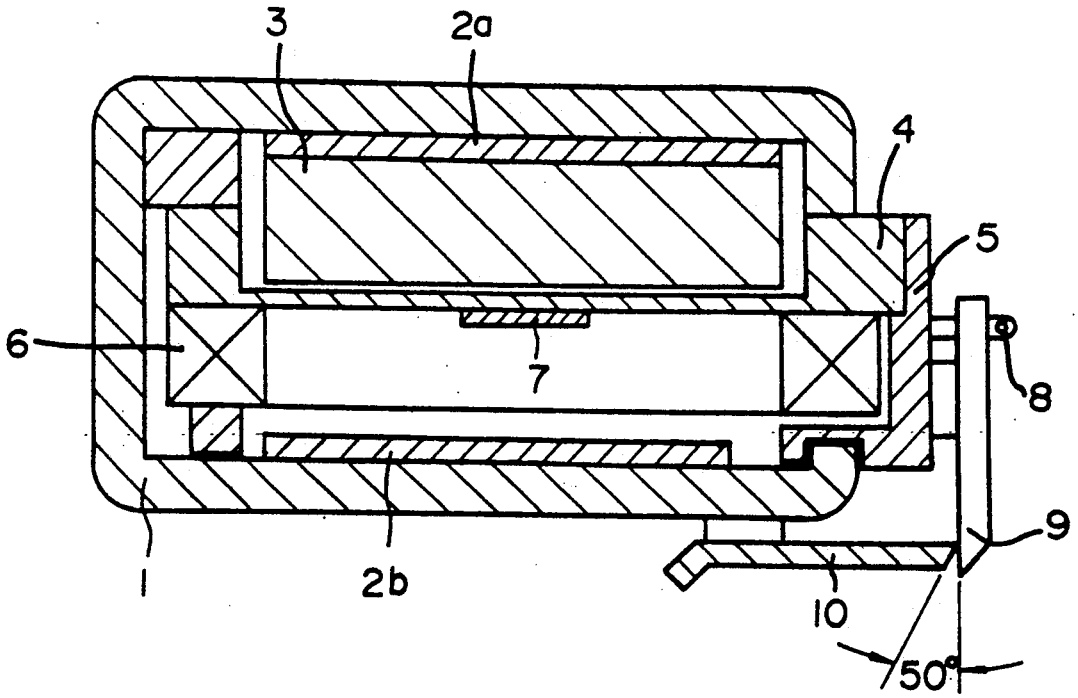
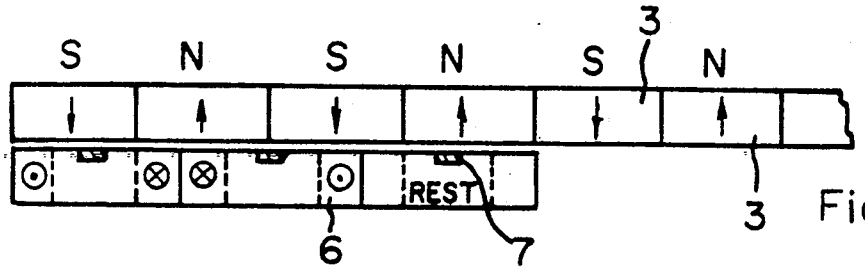
Fig. 3(1)
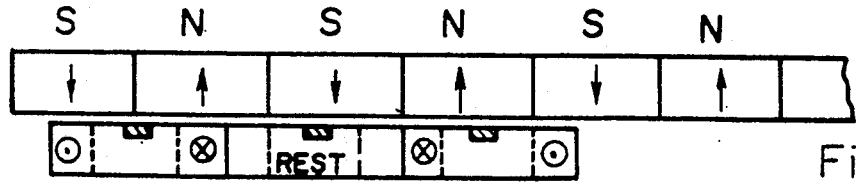
Fig. 3(2)
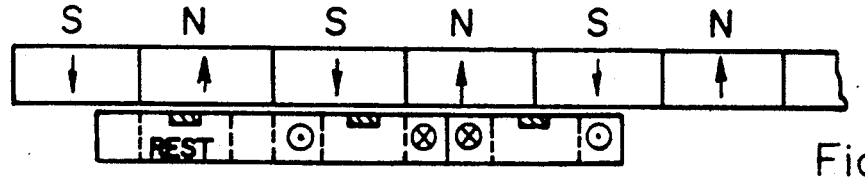
Fig. 3(3)
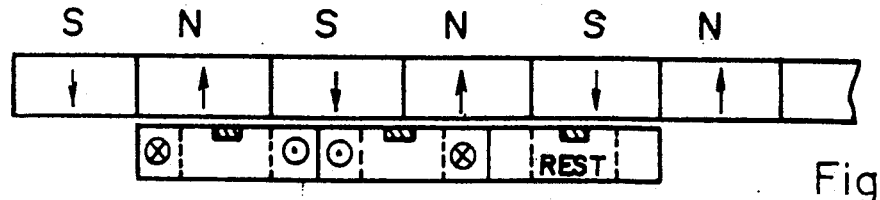
Fig. 3(4)

PAPER CUTTER

BACKGROUND OF THE INVENTION

This invention relates to a paper-cutter that includes a stationary blade and a movable blade that is suitable for use in a facsimile machine, a copying machine, or the like.

With a conventional type paper-cutter, paper is principally cut by positioning the paper between movable and stationary blades and then sliding the movable blade downward with respect to the stationary blade.

Several types of paper cutters are available, depending upon the shape of the blades and/or the method of driving the blades; for example, there is the rotary type or the press (guillotine) type.

Furthermore, there is a common type wherein the movable blade is formed as a circular blade along the distal edge of the stationary blade. Moreover, rotating the movable blade can be achieved by either connecting it directly to a drive motor, or by means of gears and pulleys linking the blade to a drive motor.

Additionally, in all these conventional types of cutting mechanisms there is a demand for higher speed cutting and a reduction in noise. For the most part, these cutting mechanisms cannot meet the high speed cutting demands. Cutting machines of these types require a close tolerance between parts accuracy, and thus high precision in assembly. Circular blade cutters also possess other problems, including a high level of noise generated by their low speed gearing, low reliability due to the complicated cutting mechanism, and inherently low cutting speeds. These conventional types of paper-cutters are not able to cope with an ever increasing demand for higher speed particularly in regard to modern facsimile machines or the like.

More specifically, conventional paper cutters generally cannot cut a sheet from a roll form in less than three seconds, and thus cannot meet the current demands of the industry.

OBJECTS AND SUMMARY OF THE INVENTION

It is an object of this invention to provide a reliable paper cutter having a low level of noise that is capable of delivering the high speeds required by the industry.

It is a more specific object of this invention to provide a driving mechanism that is coupled directly to a cutting blade in order to obtain high speed cutting in a paper cutter having both a stationary and movable blade.

It is a further object of this invention to electronically control a blade moving mechanism and to simplify the structure of paper cutting devices.

It is a still further object of this invention to employ a linear motor as a driving source for a cutting blade to eliminate mechanical elements for transferring power and to provide a certain degree of angularity between the path of travel of a movable blade and the cutting edge of the stationary blade to reduce wear on the contacting parts of a paper cutter.

It is another object of this invention to construct the movable blade of a paper cutter so that the cutting edges of the coacting moving and stationary blades form an angle that permits the device to cut in either direction when the movable blade is reciprocated in regard to the stationary blade.

It is still another object of this invention to use a rotary blade as a movable blade and to locate the edge direction of the stationary blade perpendicular to the rotary axis of the moving blade so that the paper is cut in both directions by simply reciprocating the movable blade with respect to the paper.

It is a still further object of this invention to provide a directional angle ($\theta$) between the path of travel of the movable blade and the blade edge of a stationary blade so that the tangent of the angle is in a range of more than 2/1000 and less than 5/100.

In accordance with an aspect of the invention, a paper cutter can achieve high speed cutting and its structure can be simplified because movement of the blade is controlled by a linear motor which also serves as a power-transferring element. Moreover, a low level of noise is realized by the present paper cutter through the elimination of mechanical components generally used in this type of device for transferring power.

The above and other objects, features, and advantages of this invention will be more fully understood from the following description of the invention, when considered in connection with the accompanying drawings.

BRIEF DESCRIPTION OF THE DRAWINGS

For a better understanding of these and other objects of the present invention, reference will be made to the following detailed description of the invention that is to be read in association with the following drawings, wherein

FIG. 2 is an enlarged side view in section of the paper cutter shown in FIG. 1;

FIG. 3 is a schematic diagram illustrating the drive and control features embodied in the present invention;

DETAILED DESCRIPTION OF THE PREFERRED EMBODIMENT

Figure 1:
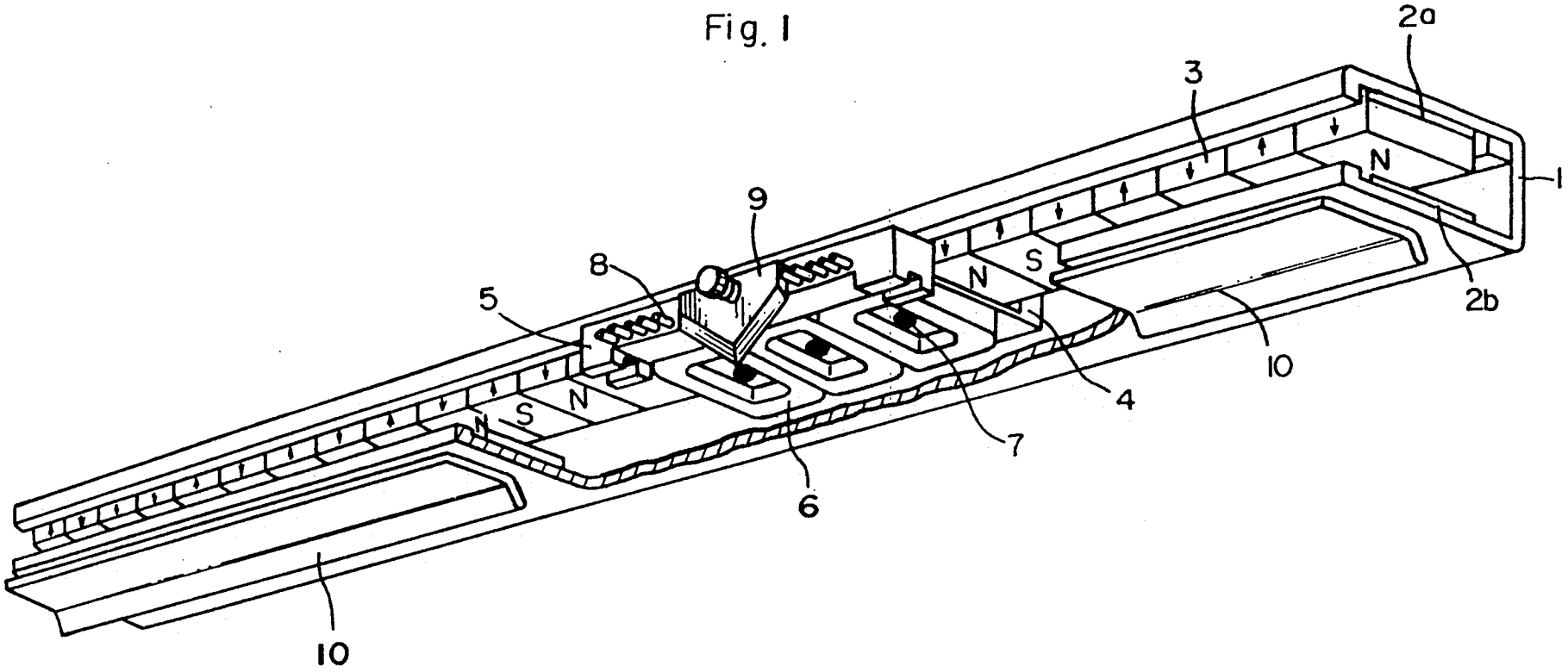
FIG. 1 is a partial perspective view of a paper cutter according to the present invention.
Figure 4:
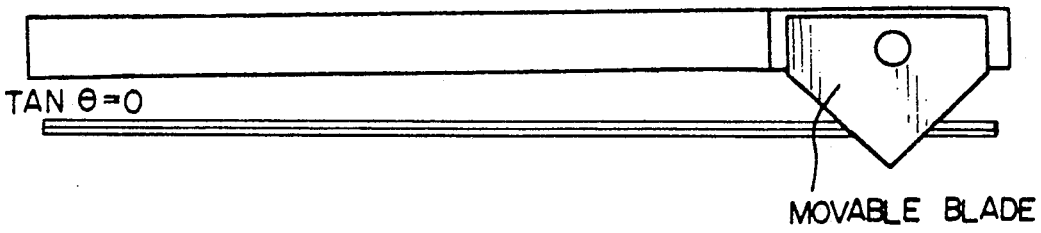
FIGS. 4 and 5 illustrate the contact zone on a typical movable blade wherein the edge of the stationary blade is parallel with the path of travel of the moving blade.

In FIG. 1 there is shown a long aluminum case whose cross section is U-shaped. Inside the aluminum case, upper yoke 2*a* and lower yoke 2*b* are installed in opposition to each other. Below the upper yoke 2*a*, a plurality of permanent magnets 3 are longitudinally mounted in such a way that the magnetic force of each permanent magnet is alternatively arranged as shown with arrow marks in FIG. 1. A coil base 4 is mounted inside the aluminum case 1, so that it straddles the permanent magnets 3. One end of a driving head 5 is fixed to the outer portion (right side of FIG. 2) of the coil base 4 and the other end of the driving head is attached loosely to a lower portion of said aluminum case 1, so that the coil base can slide on the permanent magnets in a longitudinal direction with respect to the aluminum case.

Figure 6:
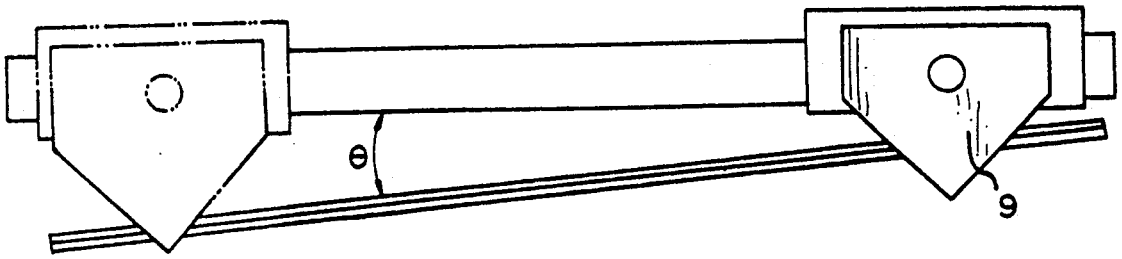
FIGS. 6 and 7 illustrate the contact zone on the moving blade utilized in the present invention wherein the edge of the stationary blade is inclined with respect to the path of travel of said moving blade.
Figure 5:
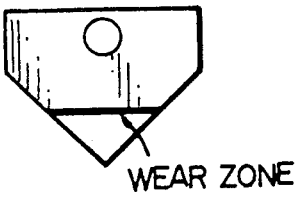

Three pieces of the coil 6 (which are herein referred to as a set) are positioned at the lower portion of the coil base 4. The width of said set is structured to be equal to that of four permanent magnets. Hall effect elements, which are used as positioning sensors, are installed at the center of each coil 6. A signal terminal 8 is connected to each coil 6. A movable blade 9 is connected to the outer side of the driving head (although a double-edge blade is shown in FIG. 2, it can be a rotary blade). Moreover, the movable blade 9 is mounted in assembly so that the linear path of travel described by the blade forms an angle with the edge (edge line) of the stationary blade 10 such that the tangent of the angle is preferably less than 5/100 and more than 2/1000. A double-edged blade or a single-edged blade 9 will thus be in contact with the stationary blade 10 along a wide contact area, thereby preventing unwanted wear or friction from being concentrated along a straight line as shown in FIGS. 5 and 6.

Figure 7:
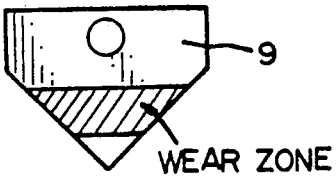

If the angle $\theta$ is less than 2/1000, the wear problem cannot be solved. When the tangent of the angle $\theta$ exceeds 5/100 (as in the case where the stationary blade has a length more than 1000mm,) the total height of the movable blade 9 will become too long and will not conform to the case size of the facsimile machine utilizing B4 size paper. This feature of the invention is best shown in FIGS. 6 and 7.

In the following, an operational function will be described which employs a linear motor principle. As shown in FIG. 3, if an electric current is supplied to the coil 6 along directions marked with arrow symbols at the step (1) when the driving head 5 is located at the left end of the permanent magnet 3, the coil 6 (driving head 5) is shifted to a right side due to Fleming's law. During the next process when a positioning sensor 7 at the left side of coil 6 is positioned between a first permanent magnet and the next adjacent permanent magnet, a signal from the positioning sensor 7 (at this moment, voltage due to Hall effect is zero) changes the current direction of the coil 6 to a new direction as shown in step (2). By sequentially changing step (3) and step (4) in a similar manner, the driving head 5 can move continuously to a rightward direction. The aforementioned control operation is so-called a three-phase-full-wave current control system that is achieved by a Hall motor controller driver IC.

Accordingly, since the movable blade 9 attached to the driving head 5 moves continuously while the movable blade is kept in contact with the stationary blade 10, a sheet of paper inserted between the movable and stationary blades will be efficiently cut.

In a case when the movable blade 9 is either a double blade or a single blade, the blade edge angle of the movable blade should be less than 50 degrees with respect to the stationary blade 10 and the flat surface of the movable blade should ride tightly in contact with the edge of the stationary blade (See FIG. 2). If the blade edge angle exceeds fifty degrees, a satisfactory cutting may not be achieved. If a rotary blade is utilized as the movable blade 9, cutting performance will be improved due to the scissor-like cutting action that is achieved between the blades.

In order to rotate the rotary blade 9, a rotation can be realized by meshing a rack mounted to the aluminum case and a pinion gear attached on the side of the rotary blade. The rotation movement is not necessarily limited to this method. For example, a pulley having a V-shaped groove can be fixed to the rotation axis of the movable blade and a stationary belt, whose cross section is trapezoid shaped, may engage the V-shaped groove to rotate the blade. As another method, an elongated rubber member having a relatively high coefficient of friction can be mounted parallel to the stationary blade to create a gap therebetween. The rotary blade is passed into the gap and held against the edge of the stationary blade by friction. Moving the rotary blade along the gap causes it to turn and thus cut any paper it comes in contact with.

As described above, the invented paper-cutter is provided with a direct driving mechanism coupled to the cutting blade for high speed cutting and the cutting function is electronically controlled. The cutter can thus meet recent demands for a speed up in cutting performance associated with the facsimile machines or the like. Moreover, the present structure is simplified since conventional mechanical power-transferring means are eliminated. Furthermore, since the movable blade can be transferred by having a contact with the stationary blade, and an advancing direction of the movable blade and blade edge (edge line) of the stationary blade are designed to form a certain degree of gradient, highly efficient and reliable paper cutting can be achieved.

While this invention has been illustrated and described with reference to a preferred embodiment, it should be understood that the embodiment serves as an example, and that many modifications and variations would present themselves to those of skill in the art without departure from the scope and spirit of this invention, as defined in the appended claims.

What is claimed is:

1. A compact high-speed reciprocating paper cutter comprising:

a non-magnetic housing having an elongated linear opening in one side wall thereof and a series of permanent magnets mounted within the housing adjacent the opening, said permanent magnets having lines of flux being perpendicular to the opening and having poles of adjacent magnets being reversed, a driving head slidably mounted within the housing for reciprocal movement parallel to said opening, a coil set mounted in said driving head having three individual coils mounted in side-by-side relationship adjacent said magnets, said set covering four magnets in the series, each coil having a current flowing in a controllable direction, sensor means associated with each coil in the set for sensing when the coil is centered between two adjacent magnets, control means responsive to said sensor means for reversing the direction of current flow through each coil when the coil is centered between two adjacent magnets whereby the driving head is moved at high speed linearly along said opening, a stationary blade secured to the housing having a linear cutting edge extending along the length of the opening, with said cutting edge being angularly offset in relation to said opening, and a movable blade connected through said opening to the driving head having a flat face that rides in contact against the cutting edge of the stationary blade so that a line of contact between said movable blade and said cutting edge moves up and down across the face of the movable blade as the driving head is moved linearly back and forth along said opening.

2. The paper cutter of claim 1 wherein the face of the cutting edge of the stationary blade forms an angle of 50° or less with the flat face of the movable blade.

3. The paper cutter of claim 1 wherein the tangent of the angle formed by the cutting edge of the stationary blade and the path of motion of the movable blade is less than 5/100 and more than 2/1000.

* * * * *